US007396204B2

(12) United States Patent
Shiraishi et al.

(10) Patent No.: US 7,396,204 B2
(45) Date of Patent: Jul. 8, 2008

(54) VARIABLE-NOZZLE MECHANISM, EXHAUST TURBOCHARGER EQUIPPED THEREWITH, AND METHOD OF MANUFACTURING EXHAUST TURBOCHARGER WITH THE VARIABLE-NOZZLE MECHANISM

(75) Inventors: Takashi Shiraishi, Sagamihara (JP); Yasuaki Jinnai, Sagamihara (JP); Motoki Ebisu, Sagamihara (JP)

(73) Assignee: Mitshubishi Heavy Industries, Ltd., Tokyo (JP)

( * ) Notice: Subject to any disclaimer, the term of this patent is extended or adjusted under 35 U.S.C. 154(b) by 538 days.

(21) Appl. No.: 10/517,831

(22) PCT Filed: Oct. 17, 2003

(86) PCT No.: PCT/JP03/13332

§ 371 (c)(1),
(2), (4) Date: Dec. 15, 2004

(87) PCT Pub. No.: WO2004/035991

PCT Pub. Date: Apr. 29, 2004

(65) Prior Publication Data

US 2005/0252210 A1 Nov. 17, 2005

(30) Foreign Application Priority Data

Oct. 18, 2002 (JP) ..... 2002-304826

(51) Int. Cl.
*F02D 23/00* (2006.01)

(52) U.S. Cl. ..... 415/160; 415/164; 415/165; 29/889.2

(58) Field of Classification Search ..... 415/160, 415/164, 165; 29/889.2
See application file for complete search history.

(56) References Cited

U.S. PATENT DOCUMENTS

| | | | |
|---|---|---|---|
| 2,428,830 | A | 10/1947 | Birmann |
| 4,679,984 | A | 7/1987 | Swihart et al. |
| 4,770,603 | A | 9/1988 | Engels et al. |
| 4,804,316 | A | 2/1989 | Fleury |
| 5,146,752 | A | 9/1992 | Bruestle |

(Continued)

FOREIGN PATENT DOCUMENTS

| | | | |
|---|---|---|---|
| EP | 0226444 | A2 | 6/1987 |

(Continued)

*Primary Examiner*—Igor Kershteyn
(74) *Attorney, Agent, or Firm*—Wenderoth, Lind & Ponack, L.L.P.

(57) ABSTRACT

An exhaust turbocharger with a variable-nozzle mechanism with fail-safe feature included is provided with which, even if wear of the drive ring supporting part where the supporting elements are in reciprocating sliding or rolling contact with each other under high temperature without lubrication increases, the drive ring can be supported on the nozzle mount on the second supporting part, which enables the drive ring to be always supported rightly on the nozzle mount, and to prevent the occurrence of eccentric rotation or dropping out of the drive ring due to excessive wear of the drive ring supporting part or the occurrence of reduction in engine performance due to malfunctions of the variable-nozzle mechanism such as the error in the relation between the output of the actuator and the nozzle vane opening or the occurrence of breakage of the variable-nozzle mechanism as has been experienced in prior arts.

11 Claims, 9 Drawing Sheets

U.S. PATENT DOCUMENTS

| | | | | |
|---|---|---|---|---|
| 6,471,470 | B2 * | 10/2002 | Yoshimura et al. | 415/160 |
| 6,669,442 | B2 * | 12/2003 | Jinnai et al. | 415/160 |
| 2001/0013339 | A1 | 8/2001 | Jinnai | |
| 2002/0098081 | A1 | 7/2002 | Ertl et al. | |
| 2003/0077167 | A1 | 4/2003 | Jinnai et al. | |

FOREIGN PATENT DOCUMENTS

| | | |
|---|---|---|
| EP | 1120547 A2 | 8/2001 |
| EP | 1236867 A2 | 9/2002 |
| EP | 1394363 A1 | 3/2004 |

* cited by examiner

VARIABLE-NOZZLE MECHANISM, EXHAUST TURBOCHARGER EQUIPPED THEREWITH, AND METHOD OF MANUFACTURING EXHAUST TURBOCHARGER WITH THE VARIABLE-NOZZLE MECHANISM

FIELD OF THE INVENTION

The present invention relates to a variable-nozzle mechanism of turbine nozzles which is applied to an exhaust turbocharger of an internal combustion engine for varying the blade angle of nozzle vanes of the exhaust turbocharger through transmitting the actuating force of an actuator to the nozzle vanes via a drive ring, and an exhaust turbocharger with the variable-nozzle mechanism to make the capacity of the turbine variable.

PRIOR ART

In these years many turbocharged internal combustion engines adopt variable capacity type turbochargers which can vary the flow rate of the exhaust gas from the engines flowing to the turbines through the scroll passages thereof according to operation conditions of the engines in order to adjust the flow rate of the exhaust gas to match the optimal operation conditions of the turbochargers.

The variable capacity type turbocharger is provided with a variable-nozzle mechanism which can vary the blade angle of nozzle vanes by transmitting the actuating force of a pneumatic actuator, electric motor type actuator, etc. to the nozzle vanes via a link mechanism.

In such a variable-nozzle mechanism as disclosed, for example, in Japanese Patent Laid-Open Publication 11-223129 (Prior art 1) or in Japanese Patent Laid-Open Publication 6-137109 (Prior art 2), driving members such as a drive ring, link plates, etc. for driving the nozzle vanes provided at the outlet part of the scroll passage through which the high temperature exhaust gas flows, are supported by the turbine casing, the members are in sliding or rolling contact with each other without lubrication.

Therefore, the sliding or rolling contact parts are liable to wear. Excessive wear of those parts induces an error in the relation of the actuator output and nozzle vane opening resulting in poor engine performance and sometimes breakage of the variable-nozzle mechanism.

A variable-nozzle mechanism is also disclosed in Japanese Patent Laid-Open Publication 62-139931 (Prior art 3) or in Japanese Patent Laid-Open Publication 2000-8870 (Prior art 4).

In prior art 3, the nozzle vanes of the variable-nozzle mechanism are supported for rotation by a nozzle mount (nozzle ring) via nozzle pins for varying the blade angle of the nozzle vanes, lever plates for connecting a drive ring and nozzle vanes are attached to the nozzle pins on the axially opposite side of the nozzle vanes, the drive ring being connected to an actuator, and the nozzle mount is fixed to the turbine casing with bolts passing through spacers inserted in the gas passage in the turbine casing where the nozzle vanes are installed.

A plurality of dowel pins are provided bridging the nozzle mount and the flange of the bearing housing, and a roller is supported for rotation on each of the dowel pins to support the inner face of the drive ring on the surface of the roller for rotation.

However, with the prior art 3, the nozzle mount for supporting the nozzle vanes and lever plates by means of the nozzle pins is fixed to the turbine casing by the bolts via the spacers inserted in the gas passage. Therefore, when mounting or dismounting the variable-nozzle mechanism to or from the exhaust turbocharger, it is necessary to tighten or loosen the bolts to attach or detach the nozzle mount to or from the turbine housing and also to fit or remove the dowel pins to the flange of the bearing housing to attach or detach the drive ring. Accordingly, the mounting and dismounting of the variable-nozzle mechanism to the exhaust turbocharger is a time-consuming work in this prior art.

Besides, there is a danger of dropping out of the spacers and dowel pins when dismounting the variable-nozzle mechanism, which may cause harm to the turbine.

In prior art 3, the nozzle mount which support the nozzle vanes and lever plates by means of nozzle pins is fixed to the turbine casing and the drive ring is attached to the flange of the bearing housing by means of the dowel pins which support the rollers, so the variable-nozzle mechanism is of a separate structure consisting of turbine casing side elements and bearing housing side elements not an integral component. Therefore, it is impossible to supply and replace the variable-nozzle mechanism as an assembled unit, and the replacement of the constituent elements of the turbocharger is not easy resulting in poor maintainability.

In prior art 4, nozzle vanes are supported for rotation by a nozzle mount in the gas inlet side, a nozzle plate of annular shape is fixed to the nozzle mount by means of nozzle supports, nozzle pins each of which is the integral part of each of the nozzle vanes are extended through the holes in the nozzle mount in the direction departing from the gas inlet passage, i.e. toward the outer side of the turbine casing, a lever plate are attached to the end part of each of the nozzle pins, and a drive ring is connected to the lever plates by means of connecting pins, the drive plate being driven by an actuator. Thus an integral type variable-nozzle mechanism is constituted.

The drive ring connecting part being located outside the turbine casing is covered with a separate gas outlet casing which is fixed to the turbine casing by means of bolts.

Further, in this prior art 4, the nozzle mount has a flange part on the outer circumference and inserted into the bore of the turbine housing, the thrust force toward the gas inlet passage being borne by the gas inlet side face of the flange part against the turbine casing, and has an inner ring part extended toward gas outlet side, the rear end of the inner ring part being brought to contact to the gas outlet casing to bear the thrust force toward the gas outlet side.

However, with prior art 4, since the drive ring connection part of the variable-nozzle mechanism is covered with the additional gas outlet casing provided apart from the turbine casing and the front end face of the gas outlet casing is used to bear the thrust force toward the gas outlet side by allowing the rear face of the inner ring part of the nozzle mount to contact the inner front face of the gas outlet casing, it is necessary to provide the gas outlet casing apart from the turbine casing, resulting in increased number of parts and increased man-hours of assembling.

Further, with prior art 4, since the drive ring connecting part of the variable-nozzle mechanism is covered with the gas outlet casing and the inner ring part of the nozzle mount is extended toward the gas outlet side to allow the rear end face thereof to contact the inner front face of the gas outlet casing to provide the bearing part of the thrust toward the gas outlet side, the length of the gas outlet side including the nozzle mount is increased resulting in increased overall length of the exhaust turbocharger.

Yet further, with prior art 4, as the side face of the flange part of the nozzle mount and the side face of the turbine casing act as the thrust bearing part toward the gas inlet passage and the front end face of the extended inner ring part of the nozzle mount and the inner front face of the gas outlet casing act as the thrust bearing part toward the gas outlet, the thrust clearance is determined uniquely depending on the dimensions in the axial direction of the turbine casing, gas outlet casing, and nozzle mount, and it takes a lot of man-hours to adjust the clearance of the thrust bearing parts.

SUMMARY OF THE INVENTION

In light of the problems mentioned above, the first objective of the present invention is to provide an exhaust turbocharger of variable turbine capacity in which the occurrence of eccentric motion or running away of the same due to excessive wear of the supporting part of the same and the occurrence of reduction in engine performance due to malfunction of the variable-nozzle mechanism caused by the eccentric motion or running away, or breakage of the variable-nozzle mechanism, can be prevented.

The second objective of the present invention is to provide an exhaust turbocharger of variable turbine capacity which demands decreased working-hours by easing the mounting and dismounting of variable-nozzle mechanism, can improve reliability by eliminating the dropping-off of some of the constituent elements when assembling, and can improve maintainability by easing the supplying and replacing of variable-nozzle mechanism as an assembled unit.

The third objective of the present invention is to provide an exhaust turbocharger of variable turbine capacity in which the turbine casing can be of one piece article, the clearance adjustment of thrust bearing part of variable-nozzle mechanism is eased, and the number of parts and assembling man-hours are reduced.

The present invention can attain the objectives mentioned above, and the invention is an exhaust turbocharger of variable turbine capacity in which the driving force of an actuator is transmitted to nozzle vanes supported for rotation by a nozzle mount through a ring assembly comprising a drive ring, link plate, lever plate, etc. to vary the angle of blade of the nozzle vanes, characterized in that the second supporting part is provided on the nozzle mount for supporting for rotation the nozzle ring when the abrasion loss of the supporting part reaches a predetermined amount.

By the first means mentioned above, when the abrasion loss of the constituent elements, among the constituent elements of the variable-nozzle mechanism, for supporting the drive ring on the nozzle mount, the nozzle ring being supported for rotation by means of the members, the members being subjected to repetitious rotations of a certain angle range driven by an actuator of the variable-nozzle mechanism under high temperature and without lubrication and liable to wear, reaches a certain extent, that is, the abrasion loss reaches the permissible amount, the drive ring becomes to be supported on the second supporting part of the nozzle mount, that is, the second supporting part performs a fail-safe function.

Therefore, the drive ring can be always supported rightly on the nozzle mount, and the occurrence of eccentric rotation or running out of the drive ring due to excessive wear of the drive ring supporting part or the occurrence of reduction in engine performance due to malfunctions of the variable-nozzle mechanism such as the error in the relation between the output of the actuator and the nozzle vane opening or the occurrence of breakage of the variable-nozzle mechanism as has been experienced in prior art 1 or in prior art 2, can be prevented.

The second means is characterized in a variable-nozzle mechanism of an exhaust turbocharger wherein the driving force of an actuator is transmitted to nozzle vanes supported for rotation by a nozzle mount to vary the angle of blade of the nozzle vanes in that the variable-nozzle mechanism is composed such that a nozzle plate of annular shape is connected to the nozzle mount by means of a plurality of nozzle supports located circumferentially between the nozzle vanes, and the drive ring is provided in the side of the nozzle mount opposite to the nozzle vanes in the axial direction of the turbocharger so that the axial position of the drive ring is restricted by thrust bearing elements attached to the nozzle mount, thus the mechanism being constructed as a variable-nozzle mechanism assembly like a kind of cartridge which is easy to incorporate to or remove form the turbocharger.

The third means is to provide an exhaust turbocharger with a variable-nozzle mechanism in which the driving force of an actuator is transmitted to nozzle vanes supported for rotation by a nozzle mount to vary the angle of blade of the nozzle vanes, characterized in that the variable-nozzle mechanism is composed such that a nozzle plate of annular shape is connected to the nozzle mount by means of a plurality of nozzle supports located circumferentially between the nozzle vanes, and the drive ring is provided in the side of the nozzle mount opposite to the nozzle vanes in the axial direction of the turbocharger so that the axial position of the drive ring is restricted by thrust bearing elements attached to the nozzle mount, thus the mechanism being constructed as a variable-nozzle mechanism assembly like a kind of cartridge, the variable-nozzle mechanism assembly is mounted to the bearing housing by centering location with the inner circumferential face of the nozzle mount to determine the radial position thereof, the turbine casing is mounted to the nozzle mount by centering location with the outer circumferential face of the nozzle mount, and the axial position of the variable-nozzle mechanism assembly is defined between the bearing housing and turbine casing by their side parts, thus the variable-nozzle mechanism being able to be easily incorporated to or removed from the turbocharger.

In the second and third means, it is preferable to compose such that the drive ring is provided in the side of the nozzle mount opposite to the nozzle vanes in the axial direction of the turbocharger so that the inner circumferential face of the drive ring is supported on the periphery part formed in the opposite side of the nozzle mount for rotation sliding, the thrust bearing elements are fixed to the opposite side end face of the nozzle mount at a plurality of locations, the axial position of the drive ring is restricted by the side faces of the thrust bearing elements and the side face of the periphery part of the nozzle mount, and the end faces of the thrust bearing elements serve as thrust bearing faces against the bearing housing.

By the second and third means, as the variable-nozzle mechanism of the exhaust turbocharger for varying the angle of blade of the nozzle vanes is constructed such that the nozzle plate of annular shape is fixed to the nozzle mount by means of a plurality of the nozzle supports located circumferentially between the nozzle vanes and the drive ring is provided in the side of the nozzle mount opposite to the nozzle vanes in the axial direction of the turbocharger so that the axial position of the drive ring is restricted by the thrust bearing elements fixed to the nozzle mount to composes a variable-nozzle mechanism assembly like a kind of cartridge, the variable-nozzle mechanism assembly can be mounted with pertinent link mechanism attached thereto to the bearing housing by centering location with the inner circumferential face of the nozzle mount to determine the radial position of the mechanism assembly, the turbine casing is mounted to the nozzle mount by centering location with the outer circumferential face of the nozzle mount, and the axial position is defined between the bearing housing and turbine casing by their side faces. Therefore, the variable-nozzle mechanism can be easily incorporated to the exhaust turbocharger without the necessity of adjusting the link mechanism after mounting and can be removed by removing only the turbine casing by loosening the bolts fixing the turbine casing to the bearing housing.

Therefore, man-hours for incorporating or removing the variable-nozzle mechanism to or from the exhaust turbocharger is largely reduced compared to prior art 3 and in addition the occurrence of dropping-off of some constituent parts when incorporating or removing the mechanism is perfectly eliminated resulting in increased reliability of turbocharger.

Further, as the variable-nozzle mechanism is constructed as a variable-nozzle mechanism assembly like a kind of cartridge, when replacing of variable-nozzle mechanism is demanded, it is possible to supply and replace easily the variable-nozzle mechanism assembly, and the maintainability of exhaust turbocharger is improved.

According to the second and third means, since the exhaust turbocharger is composed such that the variable-nozzle mechanism constructed as a variable-nozzle mechanism assembly like a kind of cartridge is mounted to the bearing housing by centering location with the inner circumferential face of the nozzle mount to determine the radial position thereof, the turbine casing is mounted to the nozzle mount by centering location with the outer circumferential face of the nozzle mount, and the axial position of the variable-nozzle mechanism assembly is defined between the bearing housing and turbine casing by their side parts, the additional gas outlet casing for covering the drive ring connecting elements and for providing the thrust bearing part to be brought into contact with the nozzle mount at the inner rear end part thereof, is not necessary to be provided as is in prior art 4, and the number of parts is reduced. Also the number of parts is reduced compared to prior art 3 resulting in decreased man-hour for assembling.

In the second and third means, the exhaust turbocharger is composed such that the variable-nozzle mechanism constructed as a variable-nozzle mechanism assembly like a kind of cartridge is mounted to the bearing housing by centering location with the inner circumferential face of the nozzle mount to determine the radial position thereof, the turbine casing is mounted to the nozzle mount by centering location with the outer circumferential face of the nozzle mount, and the axial position of the variable-nozzle mechanism assembly is defined between the bearing housing and turbine casing by their side parts, so the turbocharger with decreased length of the gas outlet side is possible to be composed compared to that of prior art 4, in which the additional gas outlet casing for covering the drive ring connecting elements and for providing the thrust bearing part by forming the extended ring part of the gas outlet casing to be brought into contact with the nozzle mount at the inner rear end part thereof is provided, and the turbocharger can be small-sized by the reduction of overall length thereof.

Further, with the second and third means, since the exhaust turbocharger is composed such that the variable-nozzle mechanism constructed as a variable-nozzle mechanism assembly like a kind of cartridge is mounted to the bearing housing by centering location with the inner circumferential face of the nozzle mount to determine the radial position thereof, the turbine casing is mounted to the nozzle mount by centering location with the outer circumferential face of the nozzle mount, the axial position of the variable-nozzle mechanism assembly is defined between the bearing housing and turbine casing by their side parts, and the first thrust bearing part is formed between the bearing housing and the front part of the nozzle ring and the second thrust bearing part is formed between the rear part of the nozzle mount and the side part of the turbine casing, the thrust clearance between the variable-nozzle mechanism constructed as a variable-nozzle mechanism assembly like a kind of cartridge and the turbine casing/bearing housing can be easily and accurately adjusted in accordance with the finished dimensions of the turbine casing and bearing housing, contrary to the case of prior art 2 in which the thrust bearing parts of gas inlet passage side and gas outlet side are uniquely defined by the axial dimensions of the turbine casing, gas outlet casing, and nozzle mount, as a result it takes a lot of times to adjust the clearance of the thrust bearing part.

In the second and third means, it is preferable that the thrust bearing elements comprise a plurality of roller elements supported for rotation on roller pins cantilever-mounted to the nozzle mount on a plurality of circumferential locations, the roller elements supporting the inner circumferential face of the drive ring so that the drive ring is possible to rotate and at the same time restricting the axial position of the drive ring.

By such a composition, the drive ring is supported at the inner circumferential face thereof on the rollers supported on the pins located circumferentially, cantilevered to the nozzle mount, so that the rotation resistance of the drive ring is small, the driving force of the variable-nozzle mechanism is reduced, and a small-sided actuator can be used for driving the variable-nozzle mechanism.

In the second and third means, it is preferable that the roller pins supporting the roller elements are fixed in the holes penetrating the nozzle mount.

With this, depth controlling of the holes when drilling is not necessary and press-in depth of the roller pin can be easily controlled by using a jig. Further, as the pressed-in depth of the roller pin can be increased, the strength of the roller pin against tilting thereof is increased.

In the second and third means, it is preferable that washers are provided on the side of the nozzle mount facing the roller elements supported on the roller pins between the roller elements and nozzle mount.

With this, the sliding clearance of the roller in axial direction can be adjusted by the thickness of the washer, so that the dimensional accuracy in axial direction of the elements contacting the roller is not required severely resulting in cost reduction in machining. When the sliding faces wear excessively, it is enough to replace the washers without replacing other components. Therefore, maintenance cost can be reduced.

In the second and third means, it is preferable that the roller pin for supporting the roller element is formed as a roller pin with a washer.

With this, as the roller pin is formed as a roller pin with a washer part to be closely contacted to the side face of the nozzle mount, the roller pin is strong against tilting force exerting thereto and smooth working of the roller is secured.

In the second and third means, it is preferable that each of the thrust bearing elements is a nail pin composed of a shaft portion to be presses into the hole in the nozzle mount and a head part of which the underside face continuing to the shaft portion serves as the thrust bearing face facing the side face of the drive ring and the top face serves a the thrust bearing face against the bearing housing.

By such a composition, although the drive ring is supported on the nozzle mount so that the inner circumferential face thereof slides on the peripheral part of the nozzle mount, the sliding contact area of the drive ring with the shaft side face of the flange part of the nail pin is small, and the drive ring can be driven with small sliding resistance. Further, by changing the press-in length of the nail pin into the hole in the nozzle mount, the thrust clearance, i.e. the clearance between the side face of the drive ring and the shaft side face of the flange part of the nail pin can be easily adjusted, in addition, the thrust clearance can be adjusted with sufficient precision without influenced by the finished dimensional accuracy of the nozzle mount.

It is also possible by pressing in the nail pin until the shaft side face of the flange part of the nail pin contacts the surface of the nozzle mount with the finished axial dimensional accuracy of the nozzle mount kept good, accurate thrust clearance can be attained. With prior arts it is necessary to keep the accuracy of both the press-in length of the nail pin and the axial dimension of the nozzle mount to get accurate thrust clearance. On the contrary, with this construction, accurate thrust clearance can be attained by either keeping the accuracy in press-in length of the nail pin or in axial dimension of the nozzle mount.

In the second and third means, it is preferable that the turbocharger is constructed such that the side of the variable-nozzle mechanism assembly is possible to contact the bosses provided in the bearing housing to define the axial position of the variable-nozzle mechanism assembly and the nozzle plate of the variable-nozzle mechanism assembly is received in the annual groove formed in the turbine casing to be supported therein.

With this construction, the thrust clearance between the bearing housing/turbine casing and the variable-nozzle mechanism assembly can be adjusted easily and accurately by changing the protrusion of the bosses from the bearing housing.

The fourth means is a method of manufacturing the exhaust turbocharger with the variable-nozzle mechanism according to the second and third means, the driving force of an actuator being transmitted to nozzle vanes supported for rotation by a nozzle mount to vary the angle of blade of the nozzle vanes, characterized in that a nozzle plate of annular shape is connected to the nozzle mount by means of a plurality of nozzle supports located circumferentially between the nozzle vanes and the drive ring is provided in the side of the nozzle mount opposite to the nozzle vanes in the axial direction of the turbocharger so that the axial position of the drive ring is defined by thrust bearing elements attached to the nozzle mount to construct a variable-nozzle mechanism assembly like a kind of cartridge, the variable-nozzle mechanism assembly is mounted to the bearing housing by centering location with the inner circumferential face of the nozzle mount to determine the radial position thereof, and the turbine casing is mounted to the nozzle mount by centering location with the outer circumferential face of the nozzle mount, thus the variable-nozzle mechanism being able to be easily incorporated to or removed from the turbocharger.

In the fourth means, it is preferable that the axial position of the variable-nozzle mechanism assembly is defined by the side part of the bearing housing and turbine casing so that the same can be easily mounted to and dismounted from the exhaust turbocharger.

With the fourth means, as the variable-nozzle mechanism is produced as a variable-nozzle mechanism assembly like a kind of cartridge and mounted to the exhaust turbocharger, the mounting and dismounting of the variable-nozzle mechanism is simple and easy. The variable-nozzle mechanism assembly can be mounted to the bearing housing by centering location with the inner circumferential face of the nozzle mount and the turbine casing can be attached to the nozzle mount by centering location with the outer circumferential face of the nozzle mount and the axial position of the nozzle mount can be defined by the side face part of the bearing housing and turbine casing with pertinent link mechanism attached, the adjusting of the link mechanism after mounting being unnecessary, so the variable-nozzle mechanism can be easily mounted to or dismounted from the turbocharger. Therefore, the man-hour for mounting and dismounting of the variable-nozzle mechanism can be reduced.

Further, the thrust clearance between the variable-nozzle mechanism constructed as a variable-nozzle mechanism assembly like a kind of cartridge and the turbine casing/bearing housing can be easily and accurately adjusted in accordance with the finished dimensions of the turbine casing and bearing housing.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 9:
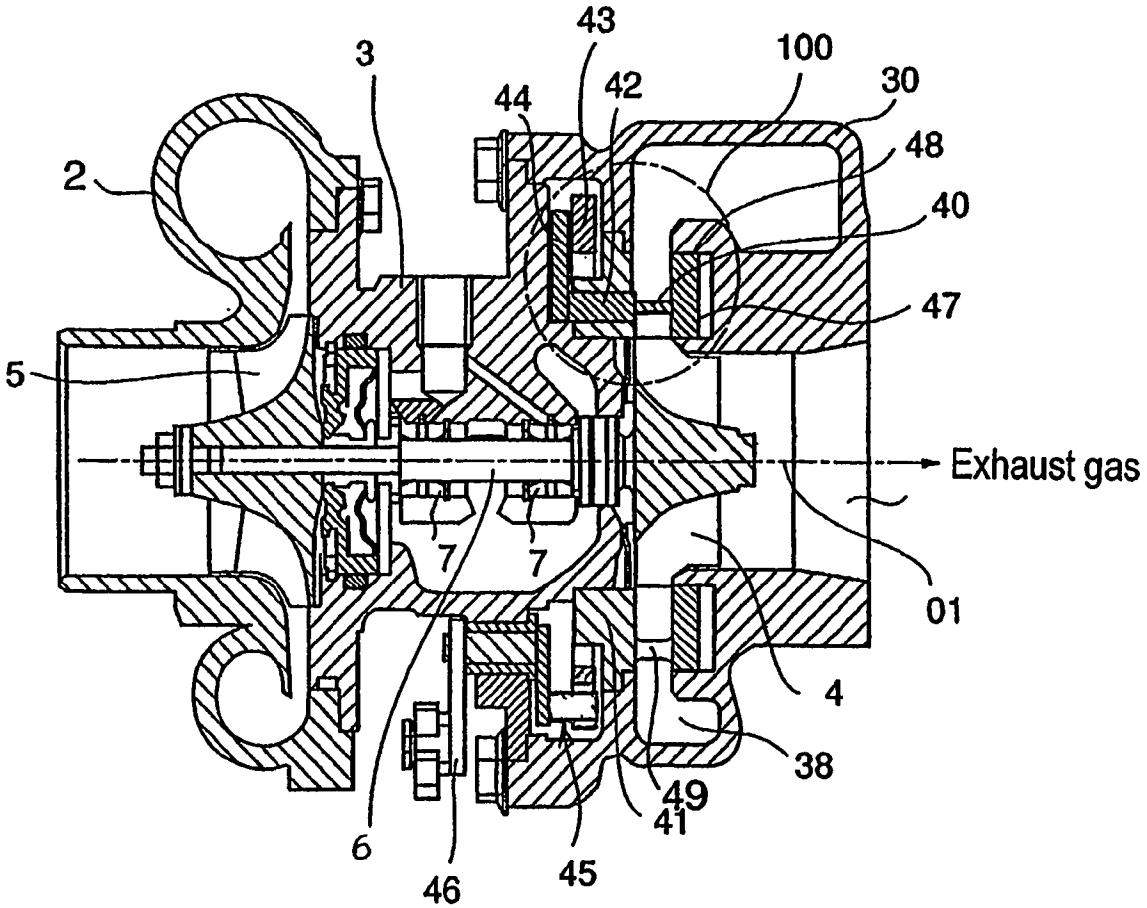
FIG. 9 is a longitudinal sectional view of a variable capacity type exhaust turbocharger to which the variable-nozzle mechanism according to the present invention is applied.
Figure 10:
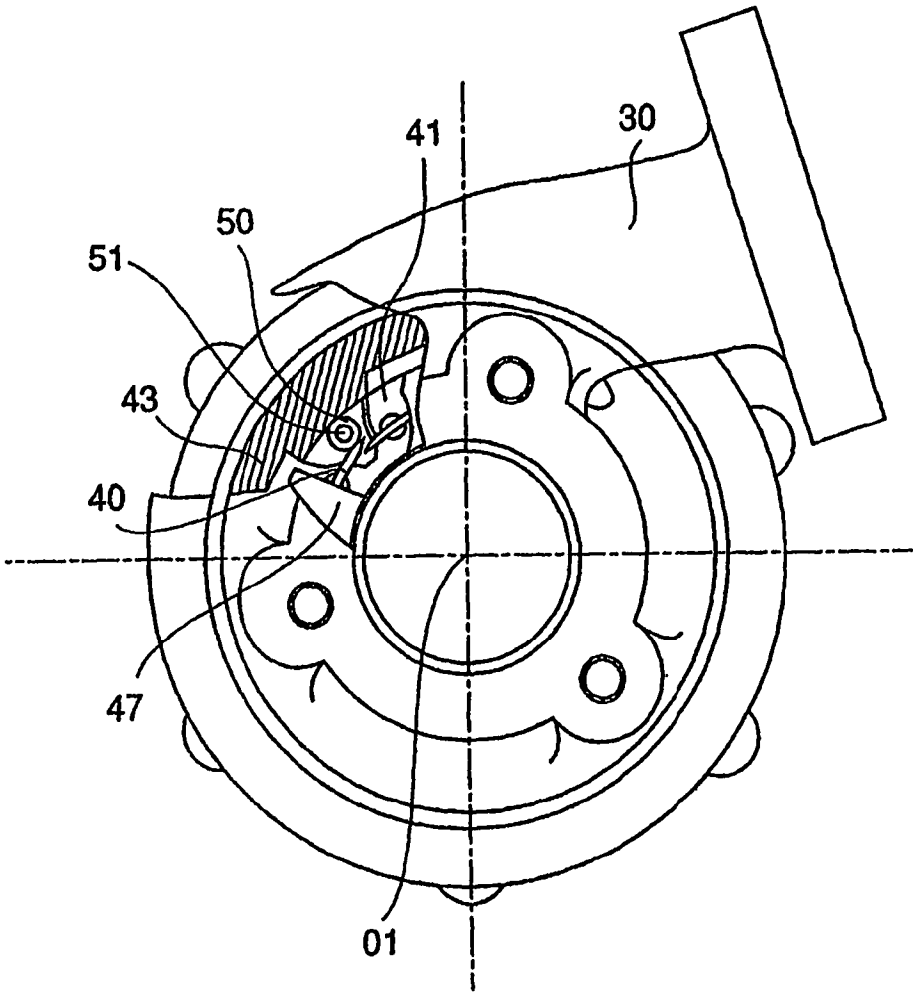
FIG. 10 is a plan view of the variable capacity type exhaust turbocharger partially cutaway.

Referring to FIG. 9 and FIG. 10 showing the structure of the variable-nozzle type exhaust turbocharger to which the present invention is applied, reference numeral 1 is a turbine casing, 38 is the scroll passage formed spiraling in the peripheral part inside the turbine casing 1, 8 is an exhaust gas outlet through which the exhaust gas expanded in a turbine wheel 4 is discharged outside of the turbocharger. Reference numeral 2 is a compressor housing, 3 is a bearing housing for connecting the compressor housing 2 and turbine casing 1.

Reference numeral 5 is a compressor wheel, 6 is a turbine shaft connecting the turbine wheel 4 and compressor wheel 5, 7 are bearings inserted in the bearing housing 3 to support the turbine shaft 6. Reference numeral 01 is the axis of rotation of the turbine shaft 6.

Reference numeral 100 indicates a variable-nozzle mechanism, 40 is a nozzle vane, a plurality of nozzle vanes being located circumferentially equally spaced in the inner circumference side of the scroll passage 38, each nozzle vane having a nozzle pin 42 formed integral with the nozzle vane, the nozzle pin 42 being supported for rotation by a nozzle mount 41 which is fixed to the turbine casing 1. The angle of blade of the nozzle vanes can be varied by the rotation of the nozzle pin 42. Reference numeral 47 is a nozzle plate connected with the nozzle mount 41 by means of a plurality of nozzle supports 49 located circumferentially and fixed to the nozzle mount 41, the nozzle plate 47 being inserted slidably into the annular groove 48 formed in the turbine casing 1.

Figure 1A:
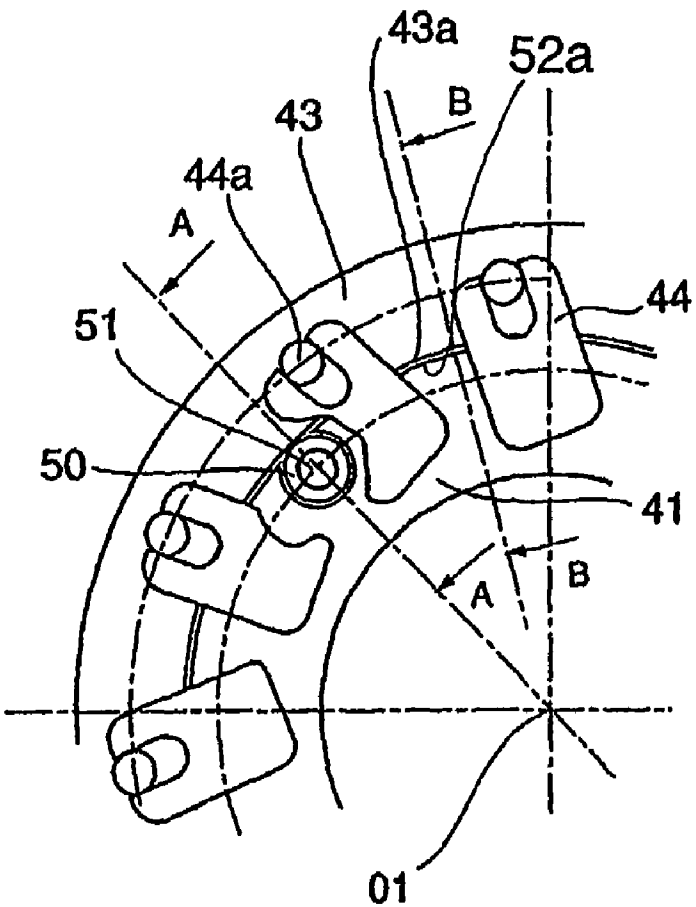
FIG. 1A is a partial plan view of the first embodiment of the variable-nozzle mechanism according to the present invention.
Figures 1B, 1C:
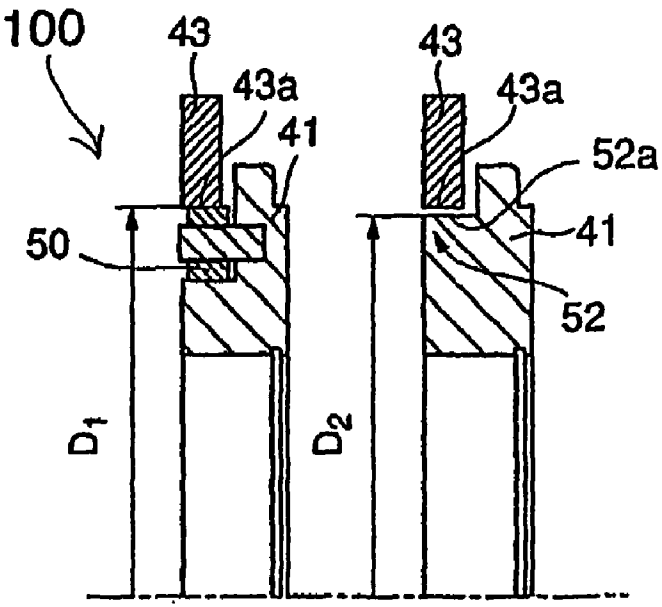
FIG. 1B is a transverse section taken along line A-A in FIG. 1A.
FIG. 1C is a transverse section taken along line B-B in FIG. 1A, with lever plates 44 and pins 44*a* removed in FIG. 1B and FIG. 1C.

Reference numeral 43 is a drive ring of ring plate shape, 44 is a lever plate for connecting the nozzle vane 40 to the drive ring 43, a plurality of lever plates 44 connecting the plurality of nozzle vanes 40 to the drive ring 43, the drive ring 43 being supported for rotation on the nozzle mount 41 on the peripheral part thereof as shown in FIG. 1A~FIG. 1C. The variable-nozzle mechanism 100 will be detailed later.

Reference numeral 45 is a control crank, 46 is a driving lever assembly, the driving force of an actuator (not shown in the drawing) is transmitted to the drive ring 43 via the driving lever assembly 46 and control crank 45 to rotate the drive ring, thereby the nozzle vanes 40 are rotated and the angle of blade of the nozzle vanes is varied.

Referring to FIG. 1A~FIG. 1C showing the first embodiment of the variable-nozzle mechanism 100 according to the present invention, reference numeral 41 is the nozzle mount, 43 is the drive ring, 44 are the lever plates for connecting the drive ring 43 and nozzle vanes 40, 44*a* are pins for connecting the drive ring 43 to the lever plates 44.

A plurality of roller pins 51 are located circumferentially and fixed to the nozzle mount 41, a roller 50 being supported for rotation on each of the roller pins 51. The drive ring 43 is supported for rotation on the nozzle mount 41 on the peripheral part thereof via the rollers 50.

In this first embodiment of the variable-nozzle mechanism 100, in addition to the inner circumference face 43*a* of the drive ring 43 being supported by the rollers in rolling contact as can be seen in FIG. 1A and FIG. 1B, the second supporting face 52*a* is provided on the peripheral part 52 of the drive ring on the portion where the rollers 50 are not attached as can be seen in FIG. 1A and FIG. 1C, diameter D2 of the peripheral part 52 of the drive ring 41 being determined to be smaller than diameter D1 of the circumcircle of the rollers 50 which coincide with the inner circumferential face 43*a* of the drive ring 43. The radial clearance between the inner circumferential face 43*a* of the drive ring 43 and the second supporting face 52*a* of the peripheral part 52 of the nozzle mount 41 is determined to be the same as the permissible maximum abrasion loss of the components.

Since the drive ring 43 is rotated in a limited angle range and the contact range of the roller 50 with the inner circumferential face 43*a* of the drive ring 43 is limited, when the components constituting the supporting part of the drive ring 43 to nozzle mount 41 such as the roller 50 and roller pin 51 and the inner circumferential face wear out excessively due to severe condition without lubrication and under high temperature and the abrasion loss of the components amounts to the radial clearance between the inner circumferential face 43*a* of the drive ring 43 and the second supporting face 52*a* of the peripheral part 52 of the nozzle mount 41, the portion of the inner circumferential face 43*a* of the drive ring 43 not contacting with the roller is directly supported on the second supporting face 43*a* of the peripheral part 52 of the nozzle mount 41 with a permissible maximum clearance.

Therefore, with the embodiment, even when wear of the contact portion of the elements constituting the supporting part of the drive ring 43 on the nozzle mount 41 increases or the breakage of the roller 50 occurs, the drive ring 43 can be supported on the second supporting face 52*a* of the nozzle mount 41. Therefore, the drive ring 43 is supported always soundly on the nozzle mount 41 and the occurrence of a malfunction such as eccentric rotation or running off of the drive ring 43 due to excessive wear of the drive ring supporting part can be evaded.

The second supporting face can be simply provided by forming the peripheral part 52*a* which serves as the second supporting part on the nozzle mount 41 without providing a separate member which demands additional cost.

Figure 2:
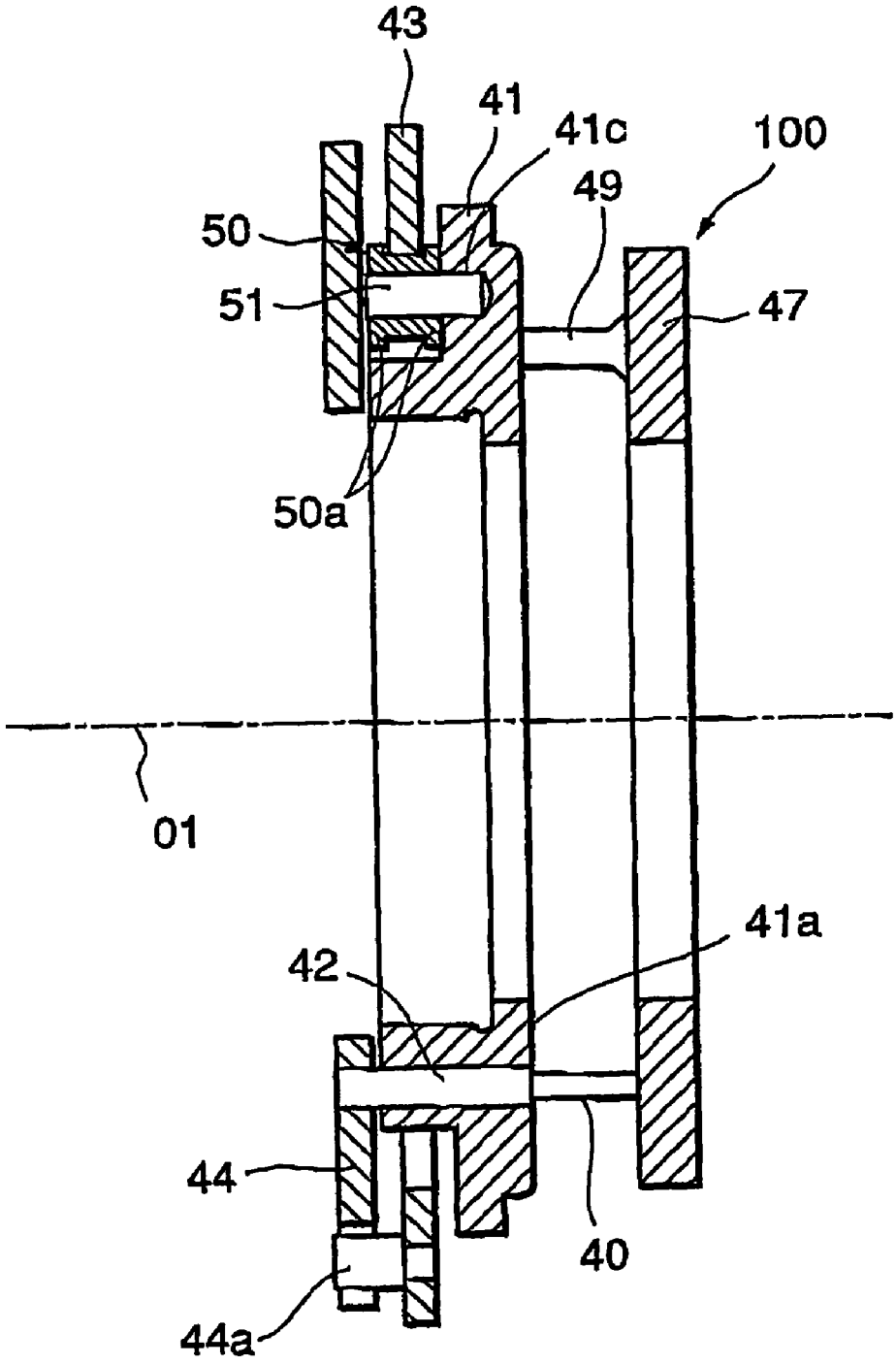
FIG. 2 is a longitudinal sectional view of the second embodiment of the variable-nozzle mechanism according to the present invention.

Referring to FIG. 2 showing the second embodiment of the variable-nozzle mechanism 100 according to the present invention, reference numeral 41 is the nozzle mount formed in an annular shape, 40 are a plurality the nozzle vanes located circumferentially equally spaced, each nozzle vane 40 being fixed to the nozzle pin 42 which is fitted to the nozzle mount and rotatable to vary the angle of blade of the nozzle vane. Reference numeral 47 is the nozzle plate of annular plate shape and is connected to the nozzle mount 41 with a plurality of nozzle supports 49 circumferentially located and fixed to the rear side (gas passage side, right side in the drawing) of the nozzle mount 41.

Reference numeral 43 is the drive ring supported on the peripheral part of the nozzle mount 41 formed in an annular shape, the drive ring being rotatable there. Reference numeral 51 are the roller pins, each of the pins 51 being pressed in to be fixed in each of a plurality of holes 41*c* drilled in the front side (bearing housing side, left side in the drawing) and located circumferentially. Reference numeral 50 are rollers supported for rotation on the roller pins 51. The rollers 50 contact the inner circumferential face of the drive ring 43 to support the same at a plurality of portions; the roller has flanges 50*a* formed at both sides thereof and the inner circumference part of the drive ring 43 is received in the groove defined by the flanges to keep the axial position of the drive ring 43.

As explained above, since the inner circumferential face of the drive ring 43 is supported at a plurality portions thereof by a plurality of rollers 50 supported for rotation on the cantilevered roller pins 51, the resistance for rotating the drive ring 43 is small, the driving force necessary to drive the variable-nozzle mechanism 100 is reduced, and a smaller sized actuator for actuating the variable-nozzle mechanism 100 can be used.

Reference numeral 44 are lever plates for connecting the drive ring 43 and the plurality of nozzle vanes 40 which are located on the front side (bearing housing side) of the drive ring 43. Each of the lever plates 44 is, as shown in FIG. 1A and FIG. 2, fixed at the rotation axis 01 side end part thereof to the end part of the nozzle pin 42 to which the nozzle vane is fixed, and a groove is formed in the other side (circumferentially outer side) end part thereof, a connecting pin 44*a* fixed to the drive ring 43 being engaged with the groove. Therefore, the lever plate 44 rotates around the center of the nozzle pin 42 when the drive ring 43 rotates, accordingly the nozzle vane fixed to the nozzle pin 42 also rotates. Thus the angle of blade of the nozzle vanes can be varied.

Because the variable-nozzle mechanism 100 is, as shown in FIG. 2, constructed as an integrated variable-nozzle mechanism assembly like a kind of cartridge, the variable-nozzle mechanism unit is able to be supplied and replaced easily when the replacement of the variable-nozzle mechanism is demanded.

Figure 3B:
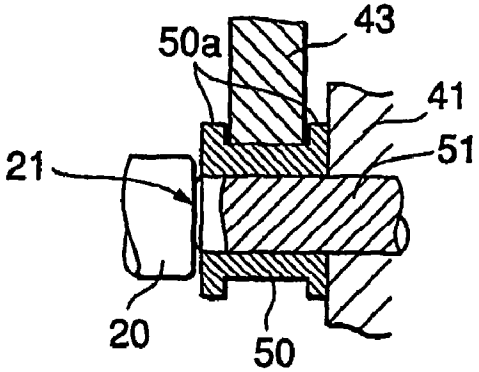
FIG. 3B is an enlarged detail of part Z in FIG. 3A.
Figure 3A:
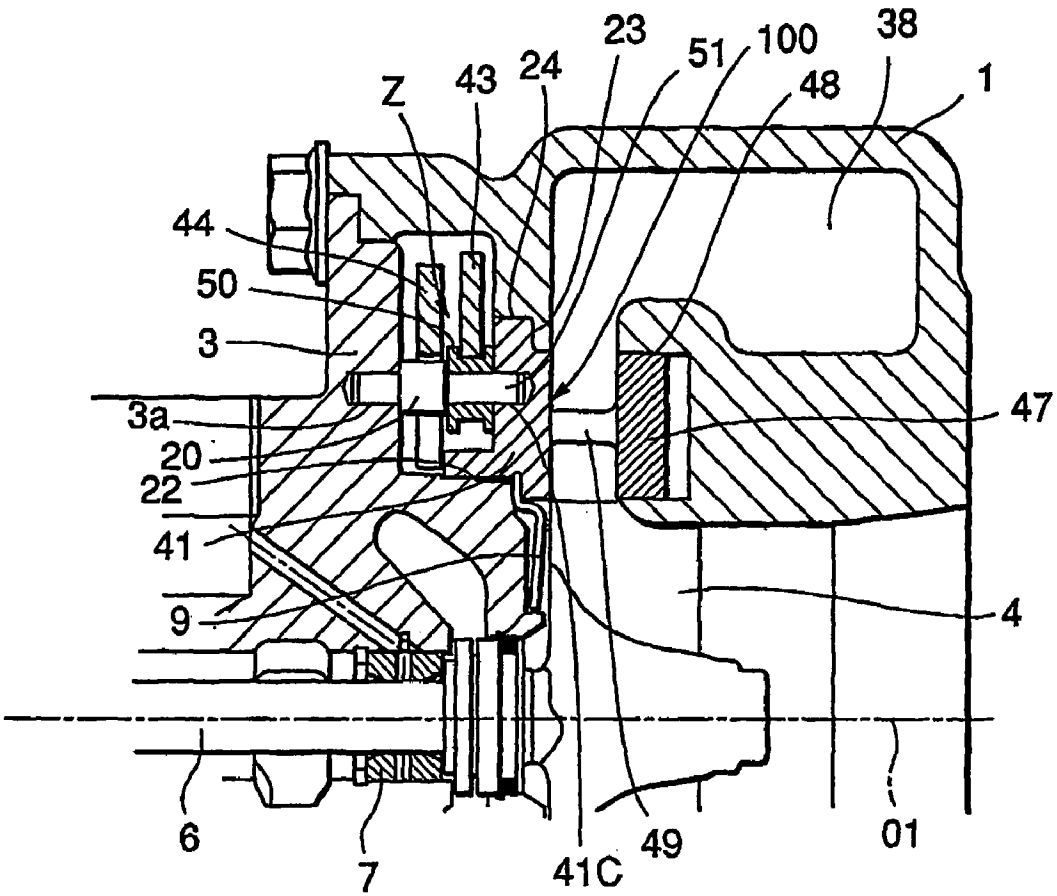
FIG. 3A is a partial longitudinal sectional view of the first embodiment of the exhaust turbocharger with the variable-nozzle mechanism according to the present invention.

FIG. 3 shows the first embodiment of the exhaust turbocharger with the first embodiment of the variable-nozzle mechanism shown in FIG. 2. In the drawing, a plurality of nozzle vanes 40 (see FIG. 9) are located circumferentially equally spaced in the inner side of the scroll passage 38 in the turbine casing 1. The nozzle pin 42 (see FIG. 9) formed integral with the nozzle vane 40 is supported for rotation by the nozzle mount 41, and the angle of blade of the nozzle vane can be varied by the rotation of the nozzle pin 42.

The nozzle mount 41 is attached to the turbine casing 1 with its perimeter fitted in the bore 24 of the turbine casing 1 and with its inner circumferential face fitted to the front part periphery 22 of the bearing housing to determine the radial position thereof.

The nozzle mount 41 has a stepped part in the peripheral part thereof and the rear side face of the stepped part contacts the thrust bearing face 23 of the turbine casing 1 to restrict the sliding of the variable-nozzle mechanism 100 toward the gas, outlet side.

The nozzle plate 47, which is connected with the nozzle mount 41 by means of a plurality of nozzle support 49 located circumferentially equally spaced and fixed to the nozzle mount 41, is fitted for sliding in the annular groove 48 formed in the turbine casing 1.

Reference numeral 20 are bosses fixed to the bearing housing 3, each of the bosses 20 is located to face each of the rollers 50. As shown in FIG. 3B, the end face of the boss 20 contacts the end face of the roller pin 51 to restrict the sliding of the variable-nozzle mechanism 100 toward the bearing housing 3 side and at the same time to prevent the roller 50 from slipping off, a slight clearance being formed between the end face of the boss 20 and the end face of the roller 50.

Reference numeral 9 is a back plate held between the bearing housing 3 and nozzle mount 41, 4 is the turbine wheel, 6 is the turbine shaft, 7 is the bearing, and 01 indicates the axis of rotation of the turbine shaft 6.

With this embodiment, the variable-nozzle mechanism 100 is composed such that the nozzle plate 47 of annular plate shape is connected with the nozzle mount 41 on the rear side (gas passage side) thereof by means of a plurality of nozzle supports 49 located between the nozzle vanes 40, the drive ring 43 is attached to the nozzle mount 41 on the front side (bearing housing side) so that the axial position of the drive ring 43 is determined by the rollers 50 by receiving the inner circumferential face of the drive ring 43 in the groove of each of a plurality of rollers supported on the roller pins 51 fixed to the nozzle mount 41, and the lever plates 44 fixed to the nozzle pins 42 for rotating the nozzle vanes are engaged with the connection pins 44*a* fixed to the drive ring 43, so the variable-nozzle mechanism 100 is constructed as an assembled unit like a kind of cartridge. Therefore, by composing the exhaust turbocharger such that the nozzle mount 41 is mounted to the turbine casing 1 with its perimeter fitted in the bore 24 of the turbine casing 1 and with its inner circumferential face fitted to the front part periphery 22 of the bearing housing to determine the radial position thereof, the rear side face of the stepped part in the peripheral part of the nozzle mount 41 contacts the thrust contact face 23 of the turbine casing 1 to restrict the sliding of the variable-nozzle mechanism 100 toward the gas outlet side, and the end face of each of the roller pins 51 contacts the end face of each of the bosses 20 to restrict the sliding of the variable-nozzle mechanism 100 toward the bearing housing 3 side, the variable-nozzle mechanism 100 can be incorporated or removed only by removing the turbine casing, without removing or replacing or adjusting the link mechanism for driving the nozzle plate. The turbine casing 1 can be easily removed only by removing the bolts fixing the turbine casing 1 to the bearing housing 3 and pulling the turbine casing 1.

The clearance of the thrust bearing part of the variable-nozzle mechanism 100 for restricting axial movement thereof, that is, the clearance between the end face of each of the bosses 20 and the end face of each of the rollers 50 can be changed by changing the protrusion of the bosses 20. In this way, accurate adjusting of the clearance is possible.

Further, as described above, since the variable-nozzle mechanism 100 is constructed as an assembled unit of variable-nozzle mechanism like a kind of cartridge, the mechanism assembly being mounted to the bearing housing by centering location 22 with the inner circumferential face of the nozzle mount to determine the radial position thereof, the turbine casing being mounted to the nozzle mount by centering location 24 with the outer circumferential face of the nozzle mount, the axial position of the variable-nozzle mechanism assembly being defined between the bearing housing and turbine casing by forming the first thrust bearing part 21 between the bearing housing 3 and the front side of nozzle mount 41 and by forming the second thrust bearing part 23 between the rear side of the nozzle mount 41 and turbine casing, the thrust clearance between the variable-nozzle mechanism 100 constructed as an assembled unit like a kind of cartridge and the turbine casing 1/bearing housing 3 can be easily and accurately adjusted in accordance with the finished dimensions of the turbine casing 1 and bearing housing 3.

Figure 4:
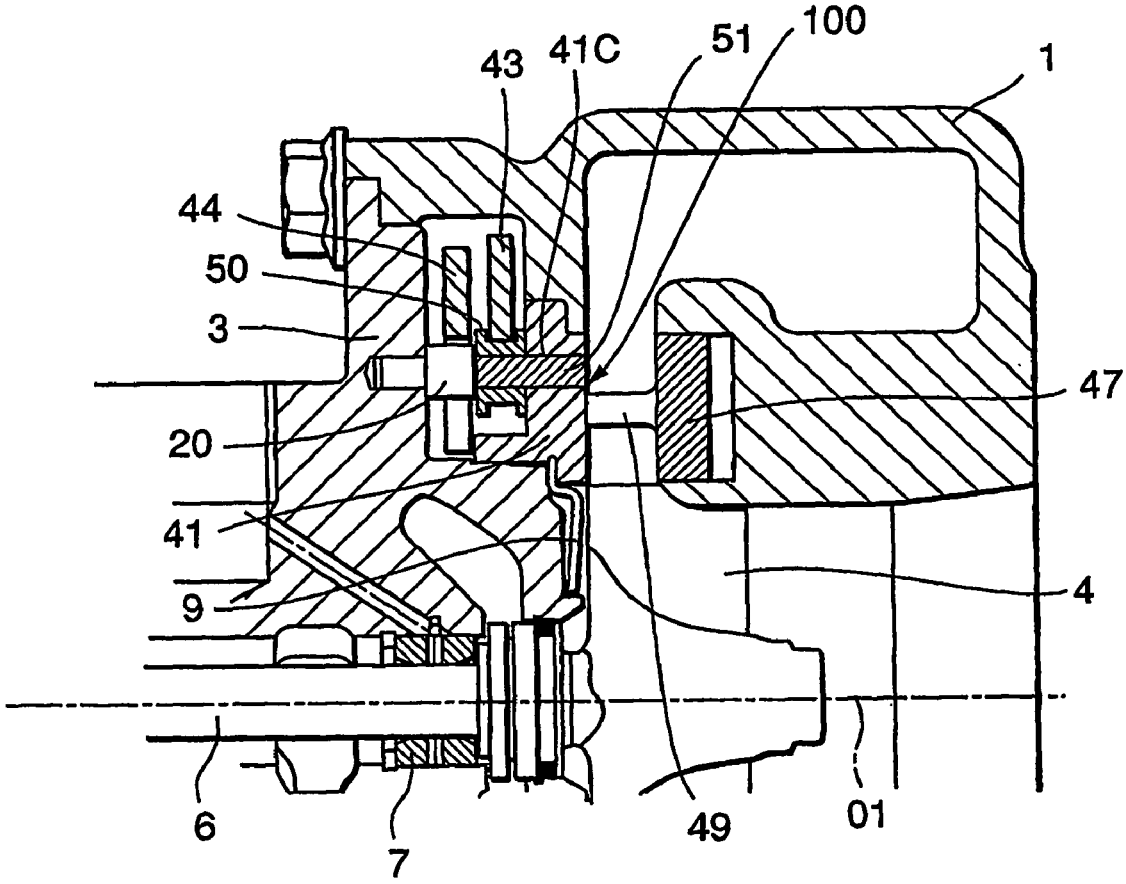
FIG. 4 is a partial longitudinal sectional view of the second embodiment of the exhaust turbocharger.

In the second embodiment of the exhaust turbocharger with the variable-nozzle mechanism 100 shown in FIG. 4, a plurality of pin holes 41*c* which were drilled circumferentially on the front side (bearing housing side) in the case of FIG. 3, are holes penetrating through the nozzle mount in FIG. 4 and the roller pins 51 are pressed into the holes.

With this embodiment, as the pin holes 41*c* drilled in the nozzle mount 41 are penetrations, depth controlling of the holes 41*c* when drilling is not necessary and press-in depth of the roller pin 51 can be easily controlled by using a jig.

Further, as the pressed-in depth of the roller pin 51 is longer than that in the case of the embodiment shown in FIG. 3, the strength of the roller pin 51 against tilting thereof is increased.

Other than that mentioned above, the embodiment shown in FIG. 4 is the same as the embodiment shown in FIG. 3 and the similar constituent elements are denoted by the same reference numerals as those of FIG. 3.

Figure 5B:
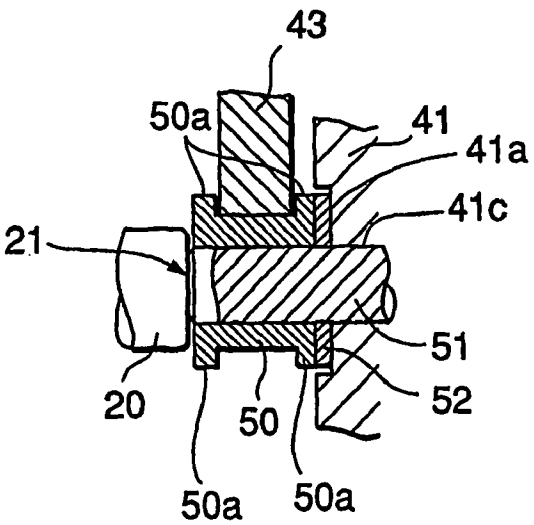
FIG. 5B is an enlarged detail of part Y in FIG. 5A.
Figure 5A:
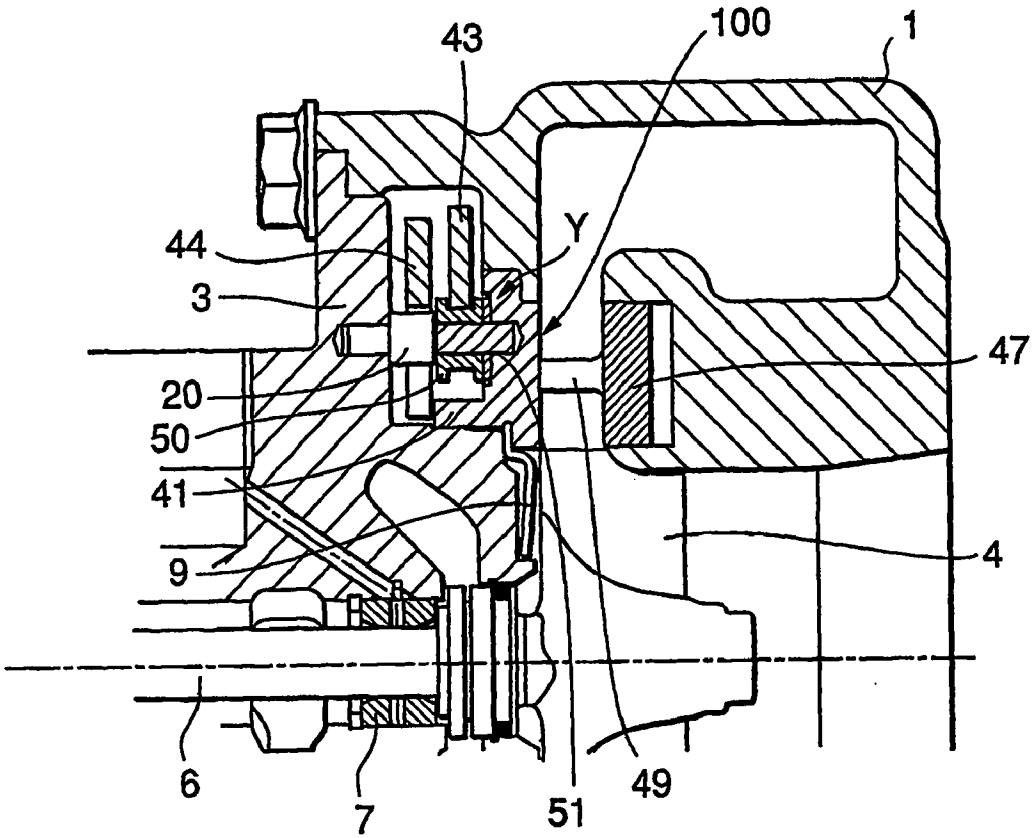
FIG. 5A is a partial longitudinal sectional view of the third embodiment of the exhaust turbocharger.

The third embodiment of the exhaust turbocharger with the variable-nozzle mechanism 100 is shown in FIG. 5A and FIG. 5B.

In this embodiment, spot faces 41*a* are formed around the holes 41*c* in the nozzle mount 41 for washers 52 to be seated between the spot faces and the rollers 50. The sliding clearance of the roller 50 in axial direction can be adjusted by the thickness of the washer, so that the accuracy of the elements contacting the roller in axial direction is not required severely resulting in cost reduction in machining.

When the sliding faces contacting the rollers 50 wear excessively, it is enough to replace the washers without replacing other components such as nozzle mount 41, rollers 50, and bosses 20. Therefore, maintenance cost can be reduced.

Other than that mentioned above, the embodiment shown in FIG. 5A and FIG. 5B is the same as the embodiment shown in FIG. 3 and the similar constituent elements are denoted by the same reference numerals as those of FIG. 3.

Figure 6B:
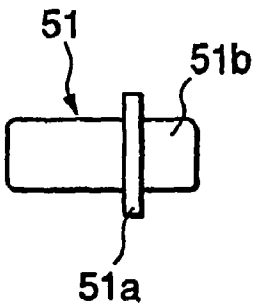
FIG. 6B is an enlarged detail of part X in FIG. 5A.
Figure 6A:
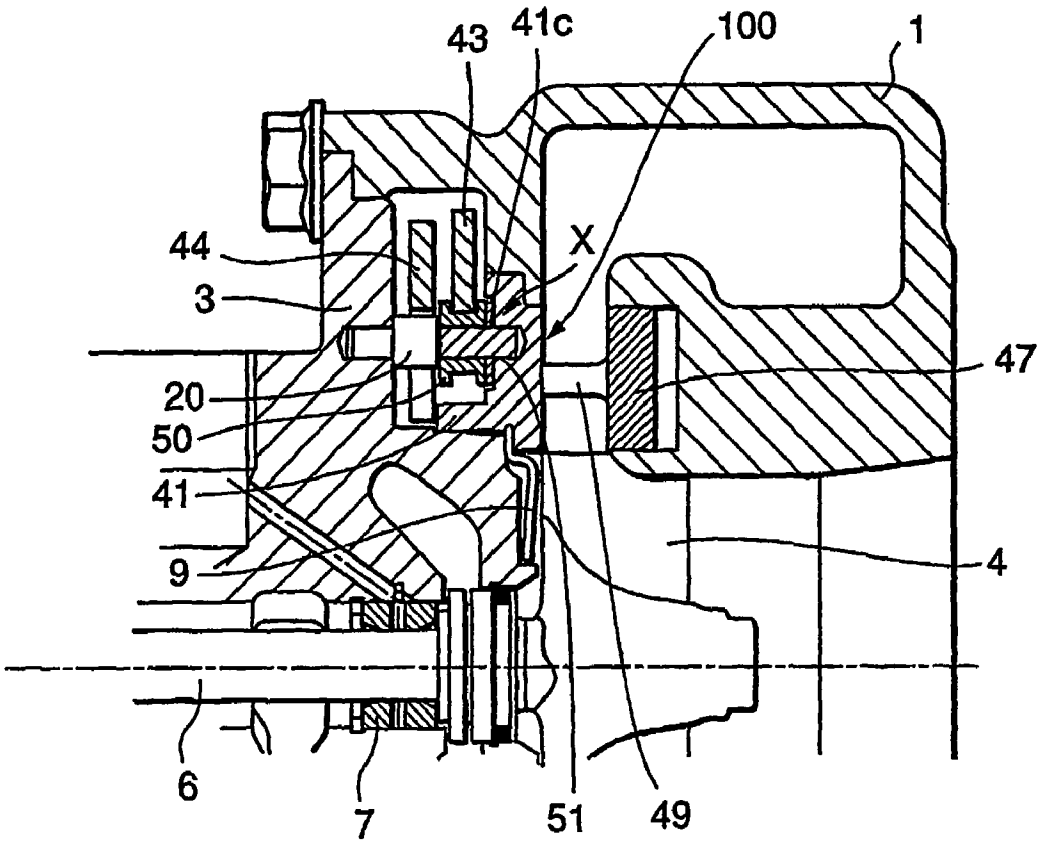
FIG. 6A is a partial longitudinal sectional view of the fourth embodiment of the exhaust turbocharger.

The fourth embodiment of the exhaust turbocharger with the variable-nozzle mechanism 100 is shown in FIG. 6A and FIG. 6B.

In this embodiment, spot faces 41*a* are formed around the holes 41*c* in the nozzle mount 41, and the roller pin 51 is formed as a roller pin with a washer, that is, a washer part 51*b* is formed as shown in FIG. 6B. As the roller pin 51 has the washer part 51*b* to be closely contacted to the side face of the nozzle mount 41, the roller pin 51 is strong against tilting thereof and smooth working of the roller 50 can be secured.

Other than that mentioned above, the embodiment shown in FIG. 6A and FIG. 6B is the same as the embodiment shown in FIG. 3 and the similar constituent elements are denoted by the same reference numerals as those of FIG. 3.

Figure 7:
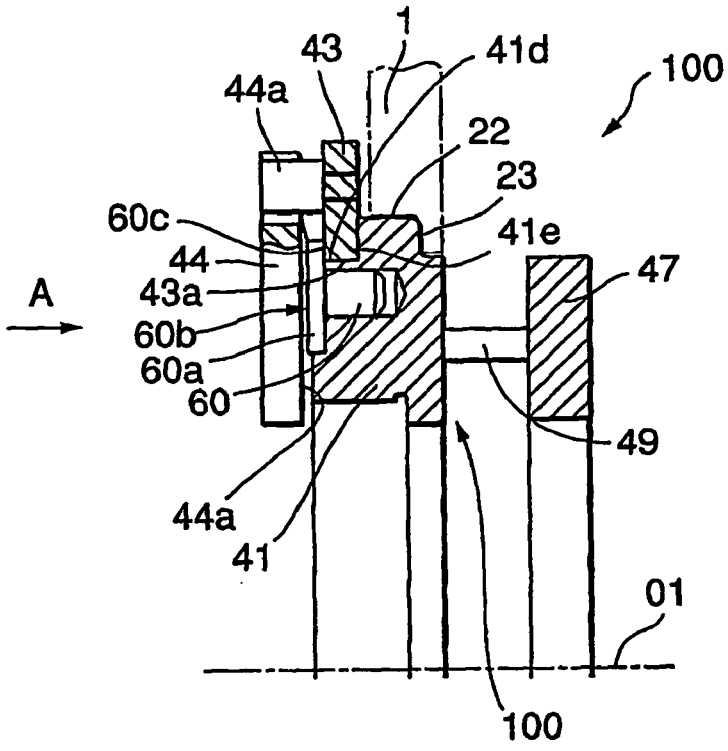
FIG. 7 is a partial longitudinal sectional view of the third embodiment of the variable-nozzle mechanism according to the present invention showing a section taken along line B-B in FIG. 8.
Figure 8:
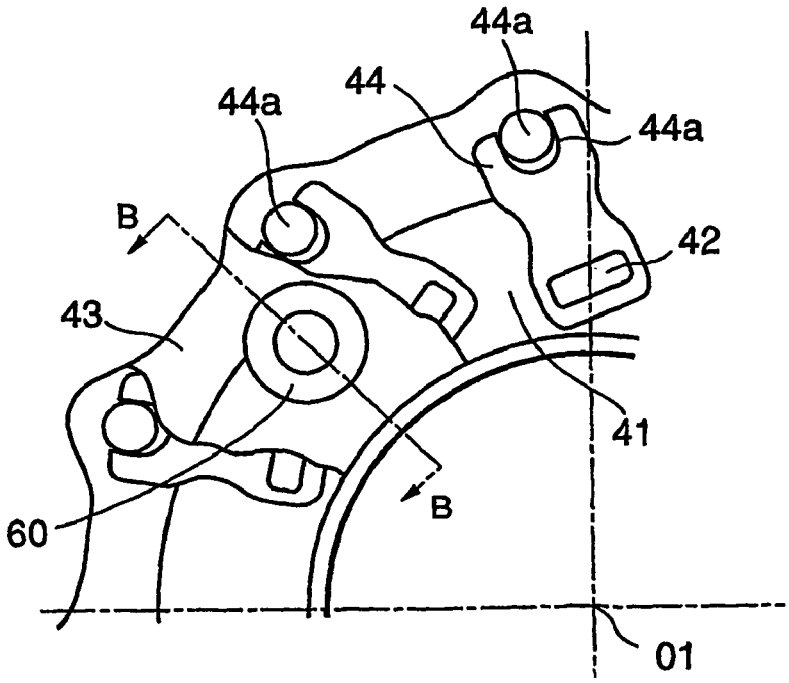
FIG. 8 is a view in the direction of arrow A in FIG. 7.

In FIG. 7 and FIG. 8 showing the third embodiment of the variable-nozzle mechanism of the present invention, the roller pins 51 and rollers 50 shown in FIG. 2~FIG. 6 are not provided. The inner circumferential face 43*a* of the drive ring 43 is allowed to slide on the periphery part 41*d* of the nozzle mount 41.

A plurality of nail pins 60, each having a shaft part to be pressed into the hole in the nozzle mount 41 and head part or flange part, are located circumferentially, the shaft side face 60*c* of the flange part of the nail pin 60 faces the side face of the drive ring 43 to serve as a thrust bearing face, and the top face 60*b* of the flange part faces the lever plate 44.

The axial position of the drive ring 43 is determined between the shaft side face 60*c* of the flange part of the nail pin 60 and the front side face 41*e* of the peripheral part of the nozzle mount 41, the drive ring being able to be rotated between them.

With this embodiment, although the drive ring 43 is supported on the nozzle mount so that the inner circumferential face 43*a* thereof slides on the periphery part 41*d* of the nozzle mount 41, the sliding contact area of the drive ring 43 with the shaft side face 60*c* of the flange part of the nail pin 60 is small and the drive ring 43 can be driven with small sliding resistance.

Further, by changing the press-in length of the nail pin 60 into the hole in the nozzle mount 41, the thrust clearance, i.e. the clearance between the side face of the drive ring 43 and the shaft side face 60*c* of the flange part of the nail pin 60 can be easily adjusted, in addition, the thrust clearance can be adjusted with sufficient precision without influenced by the finished dimensional accuracy of the nozzle mount 41.

On the other hand, by pressing in the nail pin 60 until the shaft side face 60*c* of the flange part of the nail pin 60 contacts the surface of the nozzle mount 41 with the finished dimensional accuracy of the nozzle mount 41 kept good, accurate thrust clearance can be attained. With prior arts it is necessary to keep the accuracy of both the press-in length of the nail pin and nozzle mount dimension to get accurate thrust clearance. On the contrary, with this embodiment accurate thrust clearance can be attained by either keeping the accuracy in press-in length of the nail pin or in nozzle mount dimension.

EFFECTS OF THE INVENTION

According to the present invention, when wear of the first supporting part of the drive ring reaches the permissible abrasion loss, the drive ring is supported on the second supporting part. Therefore, even if wear of the drive ring supporting part where the supporting elements are in reciprocating sliding or rolling contact with each other under high temperature without lubrication increases, the drive ring can be supported on the nozzle mount on the second supporting part, that means a fail-safe feature is included in the variable-nozzle mechanism of the present invention.

With this feature, the drive ring is always supported rightly on the nozzle mount, and the occurrence of eccentric rotation or running out of the drive ring due to excessive wear of the drive ring supporting part or the occurrence of reduction in engine performance due to malfunctions of the variable-nozzle mechanism such as errors in the relation between the output of the actuator and the nozzle vane opening or the occurrence of breakage of the variable-nozzle mechanism as has been experienced in prior arts, can be prevented.

Further, according to the present invention, the variable-nozzle mechanism constructed as a variable-nozzle mechanism assembly like a kind of cartridge is mounted to the bearing housing by centering location with the inner circumferential face of the nozzle mount to determine the radial position thereof, the turbine casing is mounted to the nozzle mount by centering location with the outer circumferential face of the nozzle mount, and the axial position of the variable-nozzle mechanism assembly is defined between the bearing housing and turbine casing by their side parts, so that the variable-nozzle mechanism with pertinent link mechanism attached thereto can be easily incorporated to the exhaust turbocharger, adjusting of the link mechanism after mounting being unnecessary, and can be removed by removing only the turbine casing by loosening the bolts fixing the turbine casing to the bearing housing.

Therefore, man-hours for incorporating or removing the variable-nozzle mechanism to or from the exhaust turbocharger is largely reduced compared to prior art 3 and in addition the occurrence of dropping-off of some constituent parts when incorporating or removing the mechanism is perfectly eliminated resulting in increased reliability of turbocharger.

As the variable-nozzle mechanism is constructed as a variable-nozzle mechanism assembly like a kind of cartridge, when replacing of variable-nozzle mechanism is demanded, it is possible to supply and replace easily the variable-nozzle mechanism assembly, and the maintainability of exhaust turbocharger is improved.

According to the present invention, since the exhaust turbocharger is composed such that the variable-nozzle mechanism constructed as a variable-nozzle mechanism assembly like a kind of cartridge is mounted to the bearing housing by centering location with the inner circumferential face of the nozzle mount to determine the radial position thereof, the turbine casing is mounted to the nozzle mount by centering location with the outer circumferential face of the nozzle mount, and the axial position of the variable-nozzle mechanism assembly is defined between the bearing housing and turbine casing by their side parts, the drive ring connection elements of the variable-nozzle mechanism are covered with the bearing housing and turbine casing. Therefore, it is unnecessary to provide an additional gas outlet casing and the number of parts is reduced resulting in decreased man-hour for assembling.

Further, it is possible to reduce the length of the gas outlet side resulting in decreased overall length of the exhaust turbocharger, thus a small-sized exhaust turbocharger can be realized.

Yet further, according to the present invention, the thrust clearance between the variable-nozzle mechanism constructed as a variable-nozzle mechanism assembly like a kind of cartridge and the thrust clearance thereof in the turbine casing and bearing housing can be easily and accurately adjusted in accordance with the finished dimensions of the turbine casing and bearing housing.

The invention claimed is:

1. A variable-nozzle mechanism of an exhaust turbocharger in which a driving force of an actuator is transmitted to nozzle vanes supported for rotation by a nozzle mount to vary an angle of a blade of the nozzle vanes, wherein the variable-nozzle mechanism is arranged such that a nozzle plate having an annular shape is connected to said nozzle mount by means of a plurality of nozzle supports located circumferentially between the nozzle vanes, and a drive ring is provided at a side of the nozzle mount opposite to the nozzle vanes in an axial direction of the turbocharger so that an axial position of said drive ring is restricted by thrust bearing elements attached to said nozzle mount, the variable-nozzle mechanism being constructed as a variable-nozzle mechanism assembly which can be incorporated to or removed from the turbocharger.

2. The variable-nozzle mechanism according to claim 1, wherein said thrust bearing elements comprise a plurality of roller elements supported for rotation and cantilever-mounted to said nozzle mount on a plurality of circumferential locations, the roller elements supporting an inner circumferential face of said drive ring so that the drive ring is rotatable and at the same time restricting the axial position of the drive ring.

3. The variable-nozzle mechanism according to claim 2, wherein roller pins supporting said roller elements to the nozzle mount are fixed in holes penetrating the nozzle mount.

4. The variable-nozzle mechanism according to claim 2, wherein washers are provided on a side of the nozzle mount facing the roller elements and roller pins supporting said roller elements to the nozzle mount are inserted in inner circumferences of said washers, respectively.

5. The variable-nozzle mechanism according to claim 2, wherein roller pins for supporting the roller elements to the nozzle mount are each formed as a roller pin with a washer.

6. The variable-nozzle mechanism according to claim 1, wherein said drive ring is provided in the side of the nozzle mount opposite to the nozzle vanes in the axial direction of the turbocharger so that an inner circumferential face of the drive ring is supported on the nozzle mount, said thrust bearing elements are fixed to an end of the nozzle mount on the side of the nozzle mount opposite to the nozzle vanes at a plurality of locations, the axial position of the drive ring is restricted by one of a side face of each thrust bearing element and a side face of a periphery part of the nozzle mount, and an end face of each thrust bearing element serves as a thrust bearing face against a bearing housing.

7. The variable-nozzle mechanism according to claim 1, wherein each of said thrust bearing elements is a nail pin comprising a shaft portion to be pressed into a hole in the nozzle mount and a head part, an underside face of the head part which continues to the shaft portion serving as a thrust bearing face facing a side face of the drive ring, and a top face of the head part serving as a thrust bearing face against a bearing housing.

8. An exhaust turbocharger with a variable-nozzle mechanism in which a driving force of an actuator is transmitted via a drive ring to nozzle vanes supported for rotation by a nozzle mount to vary an angle of a blade of the nozzle vanes, wherein said variable-nozzle mechanism is arranged such that a nozzle plate having an annular shape is connected to said nozzle mount by means of a plurality of nozzle supports located circumferentially between the nozzle vanes, and said drive ring is provided at a side of the nozzle mount opposite to the nozzle vanes in an axial direction of the turbocharger so that an axial position of said drive ring is restricted by thrust bearing elements attached to said nozzle mount, the variable-nozzle mechanism being constructed as a variable-nozzle mechanism assembly, the variable-nozzle mechanism assembly is mounted to a bearing housing by centering location with an inner circumferential face of the nozzle mount to determine a radial position thereof, a turbine casing is mounted to the nozzle mount by centering location with an outer circumferential face of the nozzle mount, and an axial position of the variable-nozzle mechanism assembly is defined between the bearing housing and turbine casing by respective side parts, the variable-nozzle mechanism being able to be incorporated to or removed from the turbocharger.

9. The exhaust turbocharger with a variable-nozzle mechanism according to claim 8, wherein the turbocharger is constructed such that a side of the variable-nozzle mechanism assembly is able to contact bosses provided in the bearing housing to define the axial position of the variable-nozzle mechanism assembly and the nozzle plate of the variable-nozzle mechanism assembly is received in an annular groove formed in the turbine casing to be supported therein.

10. A method of manufacturing an exhaust turbocharger with a variable-nozzle mechanism in which a driving force of an actuator is transmitted via a drive ring to nozzle vanes supported for rotation by a nozzle mount to vary an angle of a blade of the nozzle vanes, the method comprising:

connecting a nozzle plate having an annular shape to the nozzle mount by means of a plurality of nozzle supports located circumferentially between the nozzle vanes and the drive ring is provided at a side of the nozzle mount opposite to the nozzle vanes in an axial direction of the turbocharger so that an axial position of the drive ring is restricted by thrust bearing elements attached to the nozzle mount to construct a variable-nozzle mechanism assembly; and thereafter mounting the variable-nozzle mechanism assembly to a bearing housing by centering location with an inner circumferential face of the nozzle mount to determine a radial position thereof, and mounting the turbine casing to the nozzle mount by centering location with an outer circumferential face of the nozzle mount, the variable-nozzle mechanism being able to be incorporated to or removed from the turbocharger.

11. The method of manufacturing an exhaust turbocharger with the variable-nozzle mechanism according to claim 10, wherein in said mounting of the variable-nozzle mechanism assembly, an axial position of the variable-nozzle mechanism assembly is defined between the bearing housing and turbine casing by respective side parts so that the variable-nozzle mechanism assembly can be mounted to and dismounted from the turbocharger.

* * * * *